US005525235A

United States Patent [19]

Chen et al.

[11] Patent Number: 5,525,235

[45] Date of Patent: Jun. 11, 1996

[54] METHOD FOR SEPARATING A PETROLEUM CONTAINING EMULSION

[75] Inventors: James C. T. Chen, Houston; Daniel J. Monticello, The Woodlands, both of Tex.

[73] Assignee: Energy BioSystems Corporation, The Woodlands, Tex.

[21] Appl. No.: 243,804

[22] Filed: May 17, 1994

[51] Int. Cl.[6] ..... B01D 17/02

[52] U.S. Cl. ..... 210/641; 210/649; 210/799; 210/806; 435/282

[58] Field of Search ..... 210/282, 631, 210/641, 649, 651, 777, 799, 806; 435/282

[56] References Cited

U.S. PATENT DOCUMENTS

| | | | |
|---|---|---|---|
| 2,404,872 | 7/1946 | Walker, Jr. | 210/799 |
| 2,556,722 | 6/1951 | Hersberger | 210/799 |
| 3,517,820 | 6/1970 | Mintz | 210/491 |
| 3,728,061 | 4/1973 | Mott | 425/198 |
| 3,880,739 | 4/1975 | Leavitt | 435/147 |
| 4,088,576 | 5/1978 | Mott | 210/66 |
| 4,186,100 | 1/1980 | Mott | 210/496 |
| 4,655,927 | 4/1987 | Ford | 210/639 |
| 4,846,976 | 7/1989 | Ford | 210/651 |
| 4,886,602 | 12/1989 | Kuehne et al. | 210/641 |
| 4,944,882 | 7/1990 | Ray et al. | 210/640 |
| 5,017,294 | 5/1991 | Durrieu | 210/708 |
| 5,032,515 | 7/1991 | Tanigaki et al. | 435/134 |
| 5,227,071 | 7/1993 | Torline et al. | 210/651 |
| 5,269,934 | 12/1993 | Dubrovsky et al. | 210/651 |
| 5,356,813 | 10/1994 | Monticello | 435/282 |
| 5,358,870 | 10/1994 | Monticello et al. | 435/282 |

FOREIGN PATENT DOCUMENTS

| | | |
|---|---|---|
| 0441462A2 | 8/1990 | European Pat. Off. . |
| 0562231A1 | 3/1993 | European Pat. Off. . |
| 3913845A1 | 4/1989 | Germany . |
| WO92/19700 | 11/1992 | WIPO . |
| WO93/22403 | 11/1993 | WIPO . |

OTHER PUBLICATIONS

Mawson, A. J., "Crossflow Microfiltration of Cell Suspensions," Review Paper, *Australasian Biotechnology*, 3:348–352 (1993).

van Gassel, T. J. and Ripperger, S., "Crossflow Microfiltration in the Process Industry," Proceedings of the Symposium on Membrane Technology, Tylösand, Sweden, May 28–30, 1985, *Desalination*, 53:373–387 (1985), Elsevier Science Publishers, B.V., Amsterdam.

"Precision Porous Metals," Engineering Guide, Mott Metallurgical Corporation, Framington, Ct, DB1000.

*Primary Examiner*—Robert A. Dawson
*Assistant Examiner*—Kenneth M. Jones
*Attorney, Agent, or Firm*—Hamilton, Brook, Smith & Reynolds

[57] ABSTRACT

The invention relates to a method of separating a multiple phase liquid medium comprising a first liquid phase and a second liquid phase wherein the medium is contacted with a first filter, said filter having been wetted by a wetting agent miscible with the first liquid phase but immiscible with the second liquid phase; whereby the first liquid phase passes through the filter, thus obtaining a filtrate substantially free of the second liquid phase. In a preferred embodiment, separation of a multiple phase liquid medium comprising liquid fossil fuel, water and biocatalyst employing one or two filters is disclosed. One filter will preferentially collect either the liquid fossil fuel or aqueous phase as the filtrate. The retentate will then flow to the second filter which will collect the component not removed before, i.e. the aqueous phase or liquid fossil fuel, as the filtrate. The remaining retentate, containing the biocatalyst, can then, preferably, be recycled. The process can be used to resolve an emulsion or microemulsion of the liquid fossil fuel and aqueous phase resulting from a BDS process. Also described is a method for controlling the reaction parameters of a mixed phase reaction process.

28 Claims, 1 Drawing Sheet

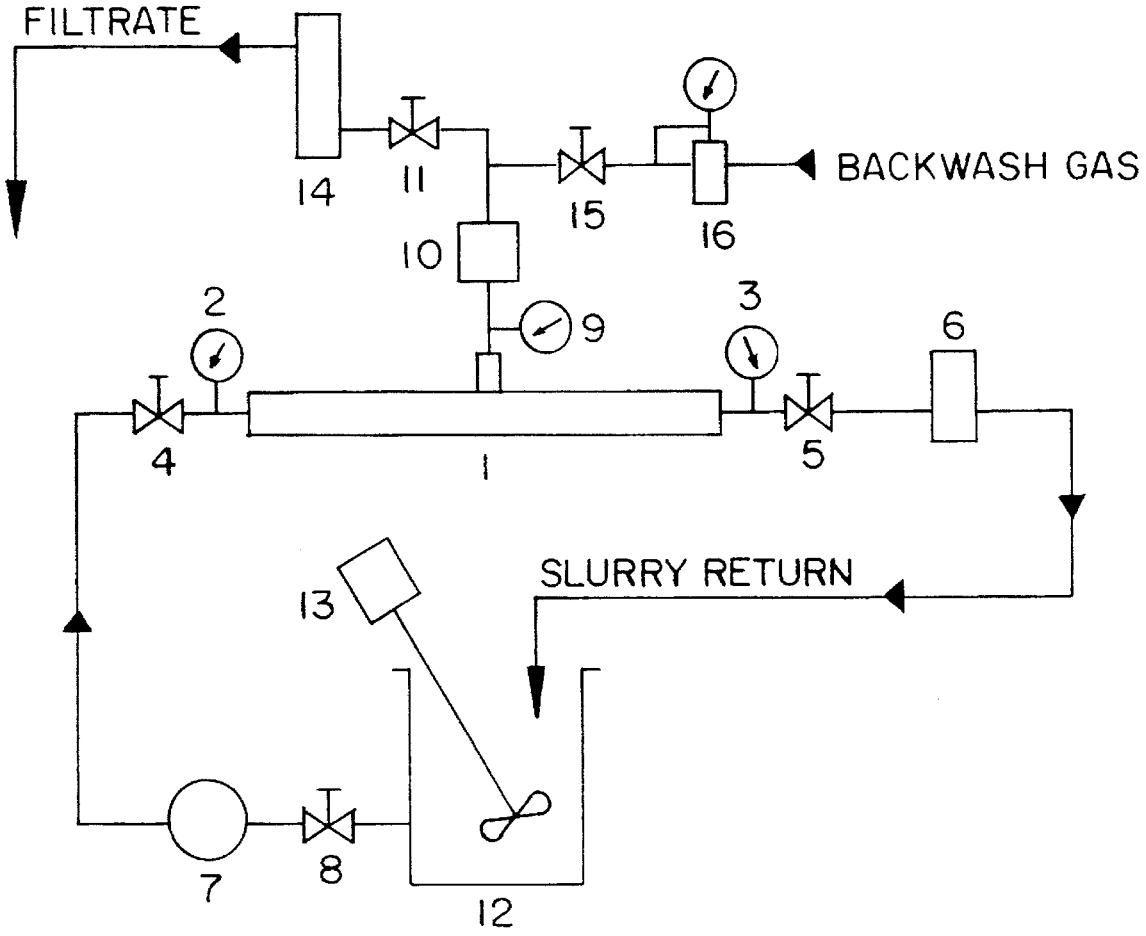
FILTRATE
BACKWASH GAS
SLURRY RETURN
1
2
3
4
5
6
7
8
9
10
11
12
13
14
15
16

METHOD FOR SEPARATING A PETROLEUM CONTAINING EMULSION

BACKGROUND OF THE INVENTION

Sulfur is an objectionable element that is typically found in fossil fuels, where it occurs both as inorganic sulfur, such as pyritic sulfur, and as organic sulfur, such as a sulfur atom or moiety present in a wide variety of hydrocarbon molecules, including for example, mercaptans, disulfides, sulfones, thiols, thioethers, thiophenes, and other more complex forms. Crude oils can typically contain, for example, amounts of sulfur up to 5 wt % or more.

The presence of sulfur in fossil fuels has been correlated with the corrosion of pipeline, pumping, and refining equipment, and with the premature breakdown of combustion engines. Sulfur also contaminates or poisons many catalysts which are used in the refining and combustion of fossil fuels. Moreover, the atmospheric emission of sulfur combustion products, such as sulfur dioxide, leads to the form of acid deposition known as acid rain. Acid rain has lasting deleterious effects on aquatic and forest ecosystems, as well as some agricultural areas located downwind of combustion facilities. To counter these problems, several methods for desulfurizing fossil fuels, either prior to or immediately after combustion, have been developed.

One recently developed technique for desulfurizing fossil fuels is known as biodesulfurization (BDS). BDS is generally described as the harnessing of metabolic processes of suitable bacteria to the desulfurization of fossil fuels. Thus, BDS typically involves mild conditions, such as ambient or physiological, and does not involve the extremes of temperature and pressure. Kilbane, U.S. Pat. No. 5,104,801 describes one such process wherein a mutant Rhodococcus strain ATCC No. 53968 selectively cleaves the C—S bond in organic carbonaceous materials. The efficiency of the BDS process can be improved by employing an emulsion or microemulsion. See copending application Ser. No. 07/897,314, now U.S. Pat. No. 5,358,970 incorporated herein by reference.

Processes, such as the above process, employ multiple liquid phases or result in the formation of emulsions or microemulsions. It is often difficult to resolve or separate emulsions and microemulsions employing conventional apparatus such as separators, coalescensors or electrical precipitators. Capillary cross-flow membranes or filters, such as those employed herein, are conventionally employed in solid-liquid separations. Mawson et al., *Australasian Biotechnology,* 3:348–352 (1993).

SUMMARY OF THE INVENTION

The invention relates to a method of separating a multiple phase liquid medium comprising a first liquid phase and a second liquid phase wherein the medium is contacted with a first filter, said filter having been wetted by a wetting agent miscible with the first liquid phase but immiscible with the second liquid phase; whereby the first liquid phase passes through the filter, thus obtaining a filtrate substantially free of the second liquid phase.

The invention relates to the separation of a multiple phase liquid medium, such as an emulsion or microemulsion of liquid fossil fuel, water and biocatalyst, employing one or two filters. One filter will preferentially collect one phase, such as the fossil fuel or aqueous phase, as the filtrate. The retentate may then flow to the second filter which will collect the phase not removed before, e.g. the aqueous phase or fossil fuel, as the filtrate. The remaining retentate, including any biocatalyst, can then, preferably, be recycled. The process can be used to resolve an emulsion or microemulsion of the fossil fuel and aqueous phase resulting from a BDS process, for example.

Advantageously, the invention effectively resolves an emulsion or microemulsion product stream achieved by BDS more completely and efficiently than accomplished by conventional equipment, such as conventional separators, coalescors or electrical precipitators.

The invention also relates to a method for the measurement and control of parameters such as the rate of reaction, degree of reaction, pH, $O_2$ or water quality in a microemulsion or other mixed phase reactor wherein the microemulsion or mixed phases are contacted with a filter prewetted with water or a liquid miscible with water. The separated water or oil phase can be fed to an analyzer such as a pH probe, or other instrument that performs measurements of, for example, oxygen content, water or oil quality parameters, sulfate content or degree of reaction, the analyzer then transmits an appropriate signal to a mechanical device (e.g., a pump) to affect pH, $O_2$ concentration or other water quality parameters. In a further embodiment, the oil phase and, optionally, cells will be subjected to additional purification and recovery and/or recycled back to the reactor.

BRIEF DESCRIPTION OF THE FIGURE

The FIGURE represents a diagram of the apparatus that can be used in the invention.

DETAILED DESCRIPTION

The features and other details of the apparatus and method of the invention will now be more particularly described and pointed out in the claims. It will be understood that the particular embodiments of the invention are shown by way of illustration and not as limitations of the invention. The principle features of this invention can be employed in various embodiments without departing from the scope of the invention.

The invention is based on the discovery that the use of filters, selective for oil or an aqueous phase, efficiently resolves an emulsion or microemulsion product stream, such as that found in a biocatalytic process, for example, a BDS process.

The wetted filter which can be employed in the invention is a wetted solid material, such as wetted sintered metal or ceramic. The pore size of the filter is selected such that the liquid phase which is miscible with the liquid employed to wet the filter passes through the filter while the second liquid phase remains. Advantageously, the pore size is selected to achieve a maximum rate of filtration. Preferably, the pore size can be selected within the range of about 0.2 to 1 micron. The porosity of the filter is similarly chosen to provide a maximum rate of filtration. However, the filter should be of sufficient strength to prevent tearing or breakage during use. Preferably, the porosity is up to about 40% by volume, more preferably between the range of about 20% to 40% by volume, such as about 30% by volume.

It is understood that the worker of ordinary skill can optimize the pore size and porosity of the filter in conjunction with the filter material to achieve a suitable filter of optimum rate of filtration vis-a-vis the filter's structural strength. In a preferred embodiment, the filter is a wetted capillary cross-flow membrane comprising sintered metal with a pore size in the range of about 0.2 to 1 micron and a porosity of between about 20% to 40% by volume, most preferably 30% by volume.

The filter so obtained is wetted with a liquid miscible with one phase to permit transport of that phase. The liquid employed to wet the filter is selected such that one liquid phase of the multiple phases to be separated is removed, while the other liquid phase is substantially retained. The other liquid phase is "substantially retained" where the ratio of the filtered phase to retained phase in the filtrate is greater than the ratio of the filtered phase to retained phase in the retentate. Preferably, the former ratio is increased by at least about 50% by weight, more preferably by at least about 75% by weight or by at least about 95% by weight. In the most preferred embodiment, the filtrate obtained visually appears as a single liquid phase.

It is preferred that the liquid to be employed as a wetting agent be selected to permit capillary flow of the miscible phase through the filter. It is preferred that the wetting agent be the same as the phase to be filtered.

For example, the "oil" filter is prewetted with a wetting agent which is miscible with the oil phase of the multiple phase liquid medium, such as an emulsion or microemulsion. Where, the oil phase of the multiple phase liquid medium is a liquid fossil fuel, the wetting agent is selected such that it is miscible with a fossil fuel but substantially immiscible with water. For example, the wetting agent can be an oil, such as a liquid fossil fuel (e.g., petroleum or a petroleum distillate fraction), or an aliphatic hydrocarbon, an aromatic hydrocarbon, synthetic oils (e.g., silicon oils), tall oils, vegetable oils, modified vegetable oils, liquid animal fats or modified liquid animal fats. Other wetting agents include non-polar solvents immiscible with water such as ethers, carbon tetrachloride, and alkyl esters. Preferably, the wetting agent is the oil to be removed, such as the liquid fossil fuel subject to filtration or a component of the liquid fossil fuel, such as an aliphatic or aromatic hydrocarbon.

The aqueous filter is wetted with a liquid miscible with water but immiscible with the oil phase, e.g. fossil fuel. For example, the wetting agent can be a hydrophilic polar solvent, such as water, alcohol, or dimethylformamide. Preferably, the wetting agent is water.

The multiple liquid phase medium comprises a first liquid phase and a second liquid phase. The first and second liquid phases are preferably substantially immiscible. The multiple liquid phase medium optionally further comprises a solid phase, such as a catalyst or biocatalyst.

The multiple liquid phase medium is contacted with the one or more filters, in any order. For example, the multiple liquid phase medium can first be contacted with the oil filter. The oil phase, e.g. fossil fuel, will flow into the miscible oil phase on the filter and through the filter, exploiting capillary force, for example. The oil filtrate, e.g. fossil fuel filtrate, substantially free of an aqueous phase (as defined above) has thus been obtained.

The retentate so obtained is optionally, contacted with the aqueous filter. The aqueous phase, containing water and, optionally, water soluble components are then removed from the product stream through capillary flow across the filter. The filtrate so obtained can then, optionally, be further purified for recovery of the water and/or water soluble compounds, such as inorganic sulfur, by methods known in the art including distillation, extraction and precipitation, for example.

The filtration is conducted under sufficient conditions to provide a positive flux across the filter. The pressure, for example, of the multiple phase liquid medium can be controlled to provide a positive flux. In a preferred embodiment, the pressure applied to the multiple phase liquid medium can be selected such that the surface tension and flux are optimized. Applicable pressures can be, for example, between about 5 to about 80 psig. The temperature at which the filtration is conducted is not critical and is selected to provide sufficient flow of the oil phase through the filtration apparatus and/or filter, where appropriate. Preferably, the temperature is conducted at a temperature between about 20° C.–40° C.

The velocity of the multiple liquid phase medium is advantageously selected to prevent the deposition or settling of any solid material which may be present in the medium. For example, where the multiple liquid phase medium is resulting from a BDS process, the velocity is selected to prevent deposition of the biocatalyst, cells, enzymes or membrane fragments. An example of a suitable velocity is between about 6 to 7 feet per second.

The order of the filtration steps can be reversed with similar results. Alternatively, the filtration steps can be conducted simultaneously. The filtration steps can be conducted in parallel or in series with each other. The multiple liquid medium can also be subjected to plural oil or water filtrations, in any combination. Likewise, the filtrates obtained by the process herein can be subjected to additional filtration steps as described above, or other conventional purification steps, such as distillation, extraction, decanting, etc.

The filters can be oriented with the feed stream in any effective manner, preferably in a tube housed within a vessel. For example, the multiple liquid phase medium is introduced through an inner tube. The filtrate flows through a filter lining the tube to the outer vessel and then transported out of the vessel. Alternatively, the tubes can be bundled within the vessel.

The remaining retentate obtained from the filtration step or steps can optionally be subjected to additional filtrations to further resolve any remaining emulsion or microemulsion. In the example of a biocatalytic process, such as a BDS process, this retentate comprises the biocatalyst and any unresolved multiple phase liquid medium, emulsion or microemulsion. Alternatively or additionally, the retentate can be subjected to a purification procedure for biocatalyst recovery, such as extraction, centrifugation, precipitation or filtration, for example. The biocatalyst and/or emulsion or microemulsion can, alternatively or additionally, be recycled to the process.

The process, as described herein, can be run as a continuous, semi-continuous or batch process, preferably a continuous process.

The FIGURE illustrates a preferred embodiment of the invention. A multiple liquid phase medium is prepared in or added to the feed tank 12, optionally equipped with an agitator 13. The medium is then pumped through pump shut-off valve 8 and inlet control valve 4, by pump 7 to the prewetted cross-flow filter 1. The pressure of the medium can be measured with inlet pressure gauge 2 and outlet pressure gauge 3. The retentate formed by the filtration returns to the feed tank 12 via the outlet control valve 5. Velocity of the medium is measured by flowmeter 6. The filtrate obtained flows to filtrate reservoir 10 and through filtrate control valve 11. The velocity of the filtrate is measured by filtrate flowmeter 14. The filter is backwashed at the end of the filtration step with a backwash gas or wetting medium via the backwash regulator 16 and backwash valve 15, through the filtrate reservoir 10 and into the filter 1. The filters can be wetted by contacting a preheated filter (e.g., by dipping) with the appropriate liquid prior to inserting the filter into the filter housing. Alternatively, the appropriate liquid can be circulated through the cross-flow filter 1 via the inlet control valve 4, for example.

The use of the above described wetted filter can further be employed to provide or enhance process control within the reactor. Specifically, the aqueous or oil phase separated employing a wetted filter as disclosed herein can be fed to one or more analyzers. The term "analyzer" is defined to include any apparatus capable of measuring a reaction parameter and providing output. There, one or more water quality parameters, such as pH, oxygen content, ion content (such as chloride or sulfate), heavy metal content, BOD, COD or organic levels or the presence of inhibitors, can be analyzed. The analyzer can, advantageously, transmit a signal to an appropriate point in the process to correct or control the reaction parameters of the process. For example, a pH probe can send a signal to chemical feed pumps regulating the pH within the reactor. An oxygen analyzer can send a signal to the pump regulating the oxygen feed.

In a BDS process, sulfate ion is produced as a by-product of the desulfurization reaction. The analysis of the concentration of sulfate ion in the aqueous phase can, accordingly, be exploited to determine the degree of desulfurization achieved within the reactor. As such, a preferred embodiment of the invention described herein is to provide an analyzer capable of monitoring the concentration of sulfate in the aqueous filtrate.

The process control as provided herein has the advantage over conventional slip stream analyzers for aqueous media as it provides a substantially oil-free phase for analysis. In conventional processes, the oil phase can coat the analyzer, interfering with the accuracy of the instrument. This can be avoided employing the process described herein.

Alternatively, the process can be employed to provide an oil phase substantially free of the aqueous phase for analysis of the oil phase. Examples, include analyzing the degree of reaction or quality of product (such as, esterification or hydrolysis of a glyceride) or the presence of sulfur in a fossil fuel, such as petroleum.

The above process is advantageously employed in a multiple liquid phase BDS process. The BDS process, as described herein, is intended to include any biocatalytic process for removing sulfur compounds from a liquid fossil fuel.

The term "sulfur compounds" generally refers to any sulfur containing molecule which is removed with the selected biocatalyst. As discussed above, sulfur is present in fossil fuels in the inorganic and organic state. Of particular interest is the removal of organic sulfur compounds which are known to be refractory to conventional hydrodesulfurization techniques, U.S. Pat. Nos. 5,002,888, 5,104,801 and 5,198,341, incorporated herein by reference. Such compounds are generally of the family of compounds known as dibenzothiophenes (DBT).

Sulfur containing liquid fossil fuels which may be desulfurized according to this invention include petroleum, petroleum distillate fractions, coal derived liquids shale, oil, bitumens, gilsonite and tars and mixtures thereof, particularly petroleum and petroleum distillate fractions as well as synthetic fuels derived therefrom.

Biocatalysts, such as those which remove sulfur compounds found in fossil fuels can be employed in this invention, and include microorganisms, active fractions thereof, enzymes and active portions of enzymes, for example. Many microorganisms are known in the art which remove sulfur from organic carbonaceous materials. Preferred are the class of microorganisms which metabolize or otherwise degrade DBT. Particularly preferred are the microorganisms described in U.S. Pat. Nos. 5,002,888, 5,104,801, 5,198,341, Kim et al., "Degradation of organic sulfur compounds and the reduction of dibenzothiophene to biphenyl and hydrogen sulfide by *Desulfovibrio desulfuricans* M6," 12 *Biotech. Lett.* (No. 10) pp. 761–764 (1990); and Omori et al., "Desulfurization of dibenzothiophene by Corynebacterium sp. strain SY1," 58 *Appl. Env. Microbiol.* (No. 3) pp. 911–915 (1992), all incorporated by reference. Particularly preferred microorganisms are Rhodococcus strain ATCC No. 53968 (IGTS8) and *Bacillus sphaericus* ATCC No. 53969. These microorganisms have the additional advantage of removing thiophenic sulfur from sulfur-bearing heterocycles, such as DBT, leaving the hydrocarbon framework thereof substantially intact. As a result, the fuel value of substrates exposed to BDS treatment does not deteriorate, as does the fuel value of a substrate exposed to other microorganisms. As disclosed in U.S. Pat. No. 5,104,801, this mutant is active for desulfurization when grown on organic sulfur sources, such as DBT and dimethyl sulfoxide (DMSO). The bacterium is found to be inactive or has reduced activity if grown in the presence of sulfate.

Microorganisms which can be employed in the claimed invention may also be made recombinantly, such as those wherein the DNA or cDNA encoding the enzyme or enzymes responsible for the desulfurization step has been transfected into a host cell. One such microorganism is that described in U.S. Ser. Nos. 07/911,845 now abandoned and 08/089,755, pending, now U.S. Pat. No. 5,356,801 both of which are incorporated herein by reference. A preferred microorganism described therein is a Rhodococcus strain wherein the cDNA encoding the desulfurization enzymes was reintroduced.

It is not required that living microorganisms be used. With certain suitable microorganisms, such as those particularly preferred as described above, the enzyme responsible for biocatalytic cleavage of carbon-sulfur bonds is present on the exterior surface of the cell envelope of the intact microorganism. Thus, non-viable microorganisms, such as heat-killed microorganisms, can be used.

The biocatalyst of the claimed invention can also include the enzyme or enzymes responsible for the biocatalytic reaction or any active fraction of the microorganism or any combination thereof.

In general, enzymes are protein catalysts made by living cells. Enzymes promote, direct, or facilitate the occurrence of a specific chemical reaction or series of reactions, which is referred to as a pathway, without themselves becoming consumed or altered as a result thereof. Enzymes can include one or more unmodified or post-translationally or synthetically modified polypeptide chains or fragments or portions thereof with or without any coenzymes, cofactors, or coreactants which collectively carry out the desired reaction or series of reactions. Biocatalytic enzyme preparations that are useful in the present invention include microbial lysates, extracts, fractions, subfractions, or purified products obtained by conventional means and capable of carrying out the desired biocatalytic function. U.S. Pat. No. 5,132,219, and U.S. Ser. No. 07/897,314, now U.S. Pat. 5,358,870 pending, filed by Monticello et al. (Jun. 11, 1992), which are incorporated by reference herein, disclose suitable enzyme preparations.

The biocatalyst can be immobilized. As set forth above, the non-viable microorganism may serve as the carrier for the biocatalyst. Other types of carriers can also be used for the present enzyme, such as a membrane, filter, polymeric resin, diatomaceous material, glass particles or beads, ceramic particles or beads or other common supports.

During biodesulfurization, the fossil fuel and aqueous phase containing the biocatalyst is preferably mixed to form an emulsion or microemulsion. A microemulsion, is defined herein as an emulsion with a droplet size of less than about 1 micron, also included within this definition are micelle and reverse micelle systems. The emulsion or microemulsion employed herein can be a stable, semi-stable or unstable system. Stability, as is defined in the art, refers to the relative time the emulsion will resolve independently. The degree of stability of the multiple liquid phase medium is not critical to the invention.

The emulsion or microemulsion formed can be made according to methods known in the art, such as those disclosed in Ser. No. 07/897,314, now U.S. Pat. No. 5,358,870 incorporated herein by reference. The continuous phase of the emulsion may be either the aqueous or oil phase, preferably the oil phase, minimizing the amount of water introduced into the reaction medium.

The emulsion or microemulsion is then reacted under conditions sufficient to bring about the removal of the sulfur compounds from the fossil fuel. Such a process is disclosed in Ser. No. 07/897,314, now U.S. Pat. No. 5,358,870 employing the preferred microorganisms. The reaction conditions required for other biocatalytic desulfurization processes can be determined by methods employed routinely in the art, including the optimization of temperature, biocatalyst concentration, water (or other solvent) concentration, oxygen concentration or mode of delivery, etc.

The reaction is allowed to proceed until a sufficient amount of the sulfur compounds are removed from the fossil fuel. The inorganic sulfur by-products thus formed are passed to the aqueous phase. The product stream so obtained, comprising the desulfurized fossil fuel, a sulfur containing aqueous phase, and an emulsion or microemulsion comprising the desulfurized fossil fuel, the sulfur containing aqueous phase and biocatalyst is subjected to the separation process employing one or more filters of the claimed invention.

Other applications of the invention include processes in preparing pharmaceuticals, foods, or chemicals or in refinery processing, for example.

The invention will now be described more specifically by the examples.

EXAMPLE

Example I—Oil Prewetted Filter

A filter element (0.087 $ft^2$ surface, 0.5 μm size, 30% porosity, 18 inches long and ⅜ inch diameter) was prewetted by heating in an oven at 150° C. for one hour, removing it from the oven and immersing in a middle distillate sample for 5 minutes. The filter element was then installed in Mott filter housing 1. Two gallons of tap water, one gallon of middle distillate and 500 grams of a recombinant Rhodococcus strain derived from ATCC 53968 (RA 18) were mixed in feed tank 12 until the mixture was homogeneous.

The emulsion was circulated through the filter by pump 7 at the rate of one gallon per minute at 20 psi, 25° C. for 30 minutes. At the end of 30 minutes, the feed pressure was raised to 40 psi and subsequently to 60 psi as shown in Table 1. The retentate, containing unresolved emulsion, an aqueous phase containing cells and any remaining oil, was returned to feed tank 12. The filtrate passed through filtrate reservoir 10 and flowmeter 14 where it was collected and analyzed. The oil filtrate was clean and bright and contained less than 100 ppm of water as determined by the Karl Fischer method (*Angew Chem.*, 394–396 (1937)). At the end of 90 minutes the filter was backwashed. During the backwash, the feed pressure was reduced to 10 psi. Valve 11 was closed and valve 15 was open for 1–2 seconds. At this time, the gas being regulated by regulator 16 at 60–80 psi was allowed to flow through valve 11 and forced the oil in reservoir 10 to flow through valve 5 and subsequently back to feed tank 12. After 1–2 seconds, the system resumed normal operation.

After backwash, the temperature of the emulsion in feed tank 12 was raised to 30° C. and the pressure was varied as before (from 20, 40, 60 psi). Flux values were measured as a function of temperature and pressure (Table I).

TABLE I

| OIL PRE-WETTED FILTER | | | |
|---|---|---|---|
| Pressure Psi | Temp °C. | Elapsed Time Min. | Flux gpm/$ft^2$ |
| 20 | 25 | 30 | 0.005 |
| 40 | 25 | 60 | 0.008 |
| 60 | 25 | 90 | 0.012 |
| 20 | 30 | 120 | 0.009 |
| 40 | 30 | 150 | 0.016 |
| 60 | 30 | 180 | 0.018 |
| 20 | 40 | 210 | 0.0105 |
| 40 | 40 | 240 | 0.0158 |
| 60 | 40 | 270 | 0.0195 |

Example II—Water Prewetted Filter

Example I was repeated, using the water in prewetting the filter in place of oil. The operating procedures and conditions were the same. The water filtrate was clean and free of oil. Table II shows the results with the filter prewetted by water.

TABLE II

| WATER PRE-WETTED FILTER | | | |
|---|---|---|---|
| Pressure Psi | Temp °C. | Elapsed Time Min. | Flux gpm/$ft^2$ |
| 20 | 25 | 30 | 0.012 |
| 40 | 25 | 60 | 0.01425 |
| 60 | 25 | 90 | 0.021 |
| 20 | 30 | 120 | 0.0135 |
| 40 | 30 | 150 | 0.0165 |
| 60 | 30 | 180 | 0.0225 |
| 20 | 40 | 210 | 0.143 |
| 40 | 40 | 240 | 0.0195 |
| 60 | 40 | 270 | 0.024 |

Example III— Oil Prewetted Filter (No Cells)

This example was done to show that the invention can be applied to breaking emulsions containing oil and water, without cells. One thousand six hundred ml of diesel fuel and 400 ml of tap water were mixed as described in Example I. An oil pre-wetted filter (0.2 μm size) was installed. The operating procedures and conditions were similar to the previous examples; however, room temperature was used and pressure was held at 10 psi. Also, no backwash was performed in these runs. Table III shows the flux as a function of time. Again, the filtrate oil was clean and bright and contained less than 100 ppm water as determined by the Karl Fischer method.

TABLE III

| OIL PRE-WETTED FILTER (NO CELLS) | | | |
|---|---|---|---|
| Pressure Psi | Temp °C. | Elapsed Time Min. | Flux gpm/ft$^2$ |
| 10 | Room | 30 | 0.094 |
| 10 | Room | 60 | 0.083 |
| 10 | Room | 90 | 0.061 |
| 10 | Room | 120 | 0.055 |

EQUIVALENTS

Those skilled in the art will recognize, or be able to ascertain using no more than routine experimentation, many equivalents to the specific embodiments of the invention described specifically herein. Such equivalents are intended to be encompassed in the scope of the claims.

We claim:

1. A method of separating an intermixed multiple phase liquid mixture comprising a liquid fossil fuel, an aqueous phase and a biocatalyst, comprising the steps:

a) wetting a first filter with a wetting agent miscible with the liquid fossil fuel but immiscible with the aqueous phase;

b) wetting a second filter with a wetting agent miscible with the aqueous phase but immiscible with the liquid fossil fuel;

c) contacting the mixture with said first filter, whereby the liquid fossil fuel passes through the filter, thus obtaining a filtrate of the liquid fossil fuel and a retentate; and d) contacting the retentate with the second filter whereby the aqueous phase passes through the filter, thereby obtaining a filtrate of the aqueous phase and a final retentate.

2. The method of claim 1 wherein the wetting agent employed in step a) is selected from the group consisting of a liquid fossil fuel, an aliphatic hydrocarbon, an aromatic hydrocarbon and mixtures thereof.

3. The method of claim 1 wherein the wetting agent employed in step a) is selected from the group consisting of petroleum distillate and a petroleum distillate fraction.

4. The method of claim 2 wherein the wetting agent employed in step b) is water.

5. The method of claim 4 wherein the intermixed multiple phase liquid mixture comprising the liquid fossil fuel, the aqueous phase and the biocatalyst was obtained from a biodesulfurization process.

6. The method of claim 5 wherein the liquid fossil fuel is a petroleum.

7. The method of claim 6 wherein the liquid fossil fuel is a petroleum distillate fraction.

8. The method of claim 5 wherein the biocatalyst desulfurizes organic sulfur compounds.

9. The method of claim 6 wherein the biocatalyst is a microorganism having the sulfur degradation characteristics of Rhodococcus strain ATCC No. 53968, an enzyme or an active fraction thereof.

10. The method of claim 9 wherein the biocatalyst is Rhodococcus strain ATCC No. 53968.

11. The method of claim 9 wherein the biocatalyst is an enzyme or an active cell fraction.

12. The method of claim 9 wherein the biocatalyst is recycled to the biodesulfurization process.

13. The method of claim 1 wherein the mixture is an emulsion or microemulsion.

14. A method of separating an intermixed multiple phase liquid mixture comprising a liquid fossil fuel, an aqueous phase and a biocatalyst, comprising the steps:

a) wetting a first filter with a wetting agent miscible with the aqueous phase but immiscible with the liquid fossil fuel;

b) wetting a second filter with a wetting agent miscible with the liquid fossil fuel but immiscible with the aqueous phase;

c) contacting the mixture with said first filter, whereby the aqueous phase passes through the filter, thus obtaining a filtrate of the aqueous phase and a retentate; and d) contacting the retentate with the second filter whereby the liquid fossil fuel passes through the filter, thereby obtaining a filtrate of the liquid fossil fuel and a final retentate.

15. The method of claim 14 wherein wetting agent of step b) is selected from the group consisting of a liquid fossil fuel, an aliphatic hydrocarbon, an aromatic hydrocarbon and mixtures thereof.

16. The method of claim 14 wherein the wetting agent of step b) is selected from the group consisting of a petroleum distillate and a petroleum distillate fraction.

17. The method of claim 15 wherein the wetting agent employed in step a) is water.

18. The method of claim 17 wherein the mixture comprising the liquid fossil fuel, the aqueous phase and the biocatalyst obtained by a biodesulfurization process.

19. The method of claim 18 wherein the liquid fossil fuel is a petroleum.

20. The method of claim 18 wherein the liquid fossil fuel is a petroleum distillate fraction.

21. The method of claim 20 wherein the biocatalyst desulfurizes organic sulfur compounds.

22. The method of claim 21 wherein the biocatalyst is a microorganism having the sulfur degradation characteristics of Rhodococcus strain ATCC No. 53968, an enzyme or an active fraction thereof.

23. The method of claim 22 wherein the biocatalyst is Rhodococcus strain ATCC No. 53968.

24. The method of claim 22 wherein the biocatalyst is an enzyme or an active cell fraction.

25. The method of claim 22 wherein the biocatalyst is recycled to the biodesulfurization process.

26. The method of claim 14 wherein the mixture is an emulsion or microemulsion.

27. A method of separating an emulsion or microemulsion comprising petroleum, an aqueous phase and a biocatalyst resulting from a biodesulfurization process, comprising the steps:

a) wetting a first filter with petroleum;

b) wetting a second filter with water;

contacting the emulsion or microemulsion with said first filter, whereby petroleum passes through the filter, thus obtaining a filtrate of petroleum and a retentate;

d) contacting the retentate with the second filter whereby the aqueous phase passes through the filter, thereby obtaining a filtrate of the aqueous phase and a final retentate containing the biocatalyst; and e) recycling the final retentate to the biodesulfurization process.

28. A method of separating an emulsion or microemulsion comprising petroleum, an aqueous phase and a biocatalyst resulting from a biodesulfurization process, comprising the steps:

a) wetting a first filter with water;

wetting a second filter with petroleum;

c) contacting the emulsion or microemulsion with first said filter, whereby the aqueous phase passes through the filter, thus obtaining a filtrate of the aqueous phase and a retentate;

d) contacting the retentate with the second filter whereby the petroleum passes through the filter, thereby obtaining a filtrate of petroleum and a final retentate containing the biocatalyst; and e) recycling the final retentate to the biodesulfurization process.

* * * * *